US005685265A

United States Patent [19]

Yoshikawa

[11] Patent Number: 5,685,265

[45] Date of Patent: Nov. 11, 1997

[54] MULTI VALVE ENGINE

[75] Inventor: Masaaki Yoshikawa, Iwata, Japan

[73] Assignee: Yamaha Hatsudoki Kabushiki Kaisha, Iwata, Japan

[21] Appl. No.: 363,708

[22] Filed: Dec. 23, 1994

Related U.S. Application Data

[63] Continuation-in-part of Ser. No. 197,610, Feb. 17, 1994.

[30] Foreign Application Priority Data

Dec. 28, 1993 [JP] Japan ..... 5-336881

[51] Int. Cl.[6] ..... F02B 75/02

[52] U.S. Cl. ..... 123/90.27; 123/432

[58] Field of Search ..... 123/308, 432, 123/90.22, 90.27, 193.5, 193.3

[56] References Cited

U.S. PATENT DOCUMENTS

| | | | |
|---|---|---|---|
| 4,007,716 | 2/1977 | Jones | 123/90.2 |
| 5,018,497 | 5/1991 | Tsuchida | 123/432 |
| 5,099,812 | 3/1992 | Yamada | 123/432 |

FOREIGN PATENT DOCUMENTS

| | | |
|---|---|---|
| 0474217 | 3/1992 | European Pat. Off. . |
| 3838305 | 5/1990 | Germany . |
| 61-268849 | 11/1986 | Japan . |
| 2173303 | 7/1990 | Japan . |
| 2230906 | 9/1990 | Japan . |
| 5071415 | 3/1993 | Japan . |

*Primary Examiner*—David A. Okonsky

*Attorney, Agent, or Firm*—Knobbe, Martens, Olson & Bear LLP

[57] ABSTRACT

A unitary cylinder head assembly for a five-valve per cylinder internal combustion engine. The cylinder head assembly has upstanding walls that form tappet receiving bores for receiving the tappets that operate the respective valves. In addition, these walls provide bearing surfaces for a pair of camshafts, one of which actuates one set of valves and the other of which actuates another set of valves. The threaded fastening means for affixing the cylinder head to the cylinder block are disposed axially beyond the walls and in the case of the set containing the greater number of valves transversely outwardly from the walls. However, the threaded fastening means are disposed so that they are equal distance from the associated cylinder bore axis.

22 Claims, 8 Drawing Sheets

MULTI VALVE ENGINE

CROSS-REFERENCE TO RELATED APPLICATION

This application is a continuation-in-part of my copending application entitled ENGINE AIR INTAKE DEVICE, Ser. No. 08/197,610, filed Feb. 17, 1994 and assigned to the assignee hereof.

BACKGROUND OF THE INVENTION

The use of multiple valve engines for improving engine performance is well known. Although four valve per cylinder engines (two intake valves and two exhaust valves) are common, the utilization of five valves per cylinder to further improve engine performance is becoming rapidly accepted. Such five-valve engines may employ either three intake valves per cylinder or three exhaust valves per cylinder, although three intake valves are more common. As the number of valves per cylinder increase, the cylinder head construction becomes more complicated, as should be readily apparent.

It is generally the practice to provide two overhead camshafts for each cylinder: one for actuating the intake valves and one for actuating the exhaust valves. The camshafts must be rotatably journaled in the cylinder head assembly and the actuator mechanism for operating the valves from the respective camshafts also must be supported in the cylinder head. Normally it is the practice to employ thimble tappets that are slidably supported in the head for actuating the valves. Obviously, these numerous components can give rise to complicated cylinder head constructions and can cause the size of the total cylinder head assembly to increase. This provides obvious spacial problems as well as difficulties in adequately supporting all of the components of the cylinder head and further affording good bolting patterns for affixing the cylinder head to the associated cylinder block.

The problem of providing a compact cylinder head assembly is further compounded by the mechanism for driving the camshafts. As is well known, the camshafts of a four-cycle engine are driven at one-half crankshaft speed. Frequently the camshafts are driven by belts or flexible transmitters that drive sprockets affixed to the camshafts. When a 2-to-1 speed ratio is involved, this provides rather large sprockets which can dictate further increases in the cylinder head construction.

In order to accommodate all of the noted requirements, it has been often the practice to make the cylinder head an assembly of more than one casting. For example, the cylinder head may comprise a main cylinder head casting which forms the combustion chambers and intake and exhaust ports. In addition, a cam carrier may be affixed to the cylinder head. This cam cover performs the function of journalling the camshafts and also slidably supporting the tappets which operate the valves. Although such two-piece constructions have some advantages, they also increase the complexity of the total construction, require additional fasteners and require further machining operations.

It is, therefore, a principal object of this invention to provide an improved, compact cylinder head for a multi-valve internal combustion engine.

It is a further object of this invention to provide an improved one-piece cylinder head for an internal combustion engine that accommodates a pair of camshafts and actuating elements for plural valves for each cylinder of the engine.

In conjunction with cylinder head assemblies of any type and particularly those for high performance multi-valve engines, it is desirable to ensure that the bolting arrangement for the cylinder head to the cylinder block is such that good sealing will be accomplished. Where the engine has plural camshafts and plural valves, previous constructions have somewhat compromised the positioning of the fasteners for holding the cylinder head to the cylinder block.

It is a further object of this invention to provide an improved bolting arrangement for a multi-valve cylinder head assembly.

The problems aforenoted are also prevalent when the camshafts operate the valves through thimble tappets that are slidably supported in the cylinder head. The body of the cylinder head which forms the bores that receive the tappet bodies is, of course, disposed in proximity to the combustion chamber. Therefore, the bolting arrangement must accommodate the cylinder head bolts within the space confines and still afford an equal load bolting pattern.

It is, therefore, a still further object of this invention to provide an improved cylinder head construction for an engine wherein a plurality of individual tappet bodies may be supported in the cylinder head and the threaded fasteners for affixing the cylinder head to the cylinder block are disposed so that they will provide an equal hold down load.

Where the cylinder head directly journals the camshafts of the engine, it is obviously necessary to afford bearing caps that cooperate with the cylinder head to provide the rotational support for the camshafts. These bearing caps must be affixed to the cylinder head in addition to the necessity of providing the hold down bolts for the cylinder head itself.

It is, therefore, a still further object of this invention to provide an improved hold down arrangement for the cylinder head and bearing cap arrangement of an overhead camshaft internal combustion engine.

SUMMARY OF THE INVENTION

A first feature of this invention is adapted to be embodied in a cylinder head assembly for an internal combustion engine. The cylinder head comprises a lower surface that is adapted to sealingly engage a cylinder block around a cylinder bore. A first series of three poppet type vales are supported for reciprocation within the cylinder head on substantially one side of a plane containing the axis of the cylinder bore. A second series of at least two poppet valves are supported for reciprocation in the cylinder head substantially on the other side of the plane. A first camshaft is rotatably journaled by the cylinder head and operates the first set of valves. A second camshaft is rotatably journaled by the cylinder head and operates the second set of valves. A first pair of threaded fastening means are disposed on the other side of the plane and substantially at the same distance therefrom as the second camshaft for affixing the cylinder head to the associated cylinder block. A second pair of threaded fastening means are provided on the one side of the plane and spaced further from the plane than the rotational axis of the first camshaft for affixing the cylinder head to the cylinder block.

Another feature of the invention is adapted to be embodied in a cylinder head assembly for an internal combustion engine having a lower surface for sealingly engaging a cylinder block around a cylinder bore therein. A first series of three popper vales are supported for reciprocation within the cylinder head on substantially one side of a plane containing the axis of the cylinder bore. A second set of at least two poppet valves are supported for reciprocation within the cylinder head on the other side of the plane. A first camshaft is rotatably journaled on bearing surfaces in the cylinder head on the one side of the plane for operating the first set of poppet valves. A second camshaft is rotatably journaled in bearing surfaces of the cylinder head on the other side of the plane for operating the second set of valves. Bearing cap means are affixed to the cylinder head for rotatably journalling the camshafts. Two pairs of threaded fastening means, each pair being disposed on a respective side of the plane, affix the cylinder head to the associated cylinder block. The pairs of threaded fastening means are disposed transversely outwardly from the bearing caps in the direction of the plane.

A further feature of the invention is also adapted to be embodied in a cylinder head assembly for an internal combustion engine having a lower surface adapted to be sealingly engaged with a cylinder block around a cylinder bore. A first series of at least three poppet valves are supported for reciprocation within the cylinder head on one side of a plane containing the axes of the cylinder bore. A first camshaft is rotatably journaled in bearing surfaces formed integrally in the cylinder head on the one side of the plane and associated with the first set of poppet valves. At least three tappet bores are formed integrally in the cylinder head in proximity to the bearing surfaces on one side of the cylinder head for slidably supporting respective bucket tappets for operating the first series of poppet valves from the first camshaft. A second series of at least two popper valves are supported for reciprocation within the cylinder head on the other side of the plane. A second camshaft is rotatably journaled and bearing surfaces formed integrally in the cylinder head on the other side of the plane. A second series of tappet bores are formed in the cylinder head on the other side of the plane for receiving a second series of tappets for operating the second set of poppet valves from the second camshaft.

DETAILED DESCRIPTION OF THE PREFERRED EMBODIMENT OF THE INVENTION

Figure 1:
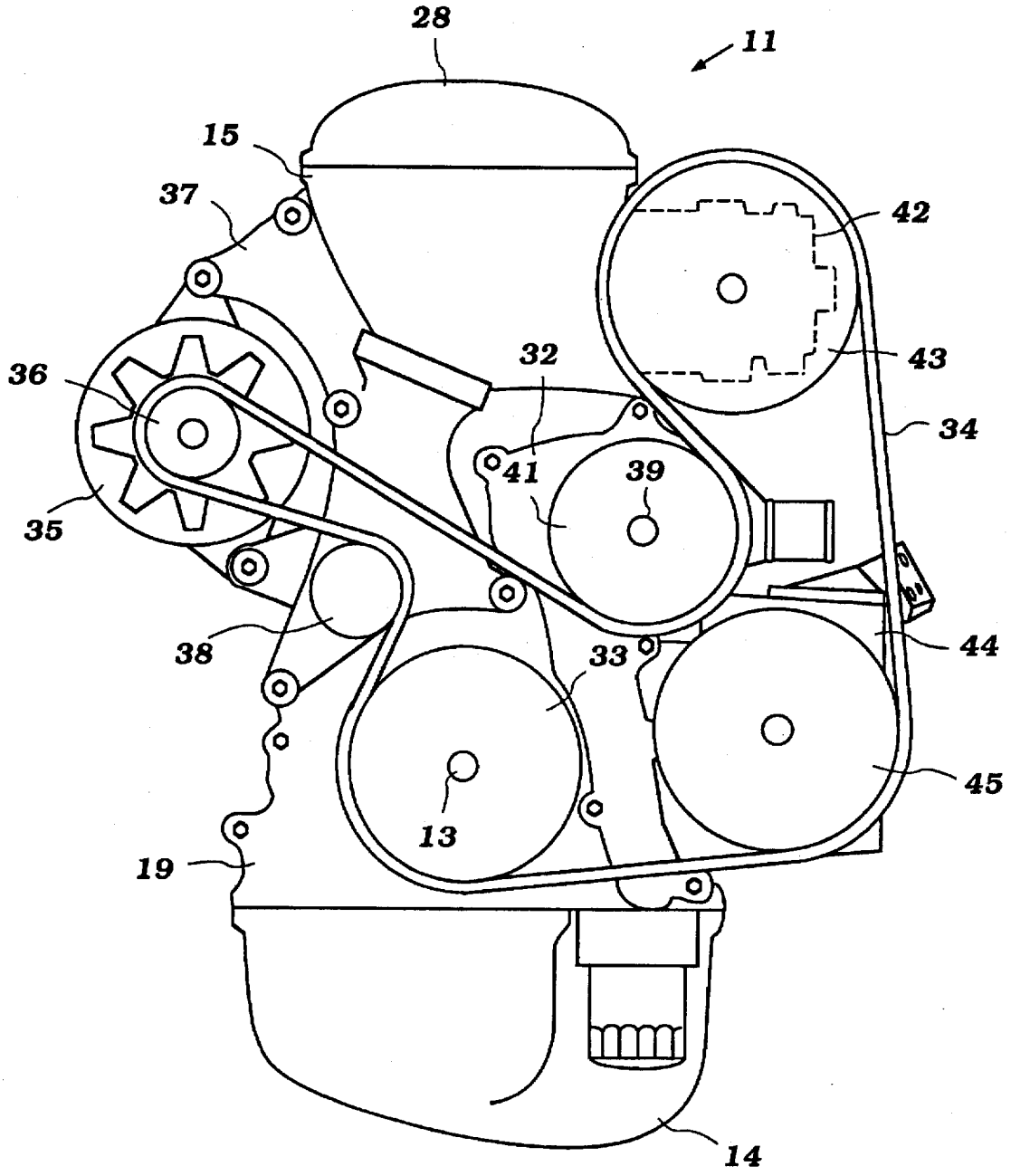
FIG. 1 is a front elevational view of an internal combustion engine constructed in accordance with an embodiment of the invention.
Figure 2:
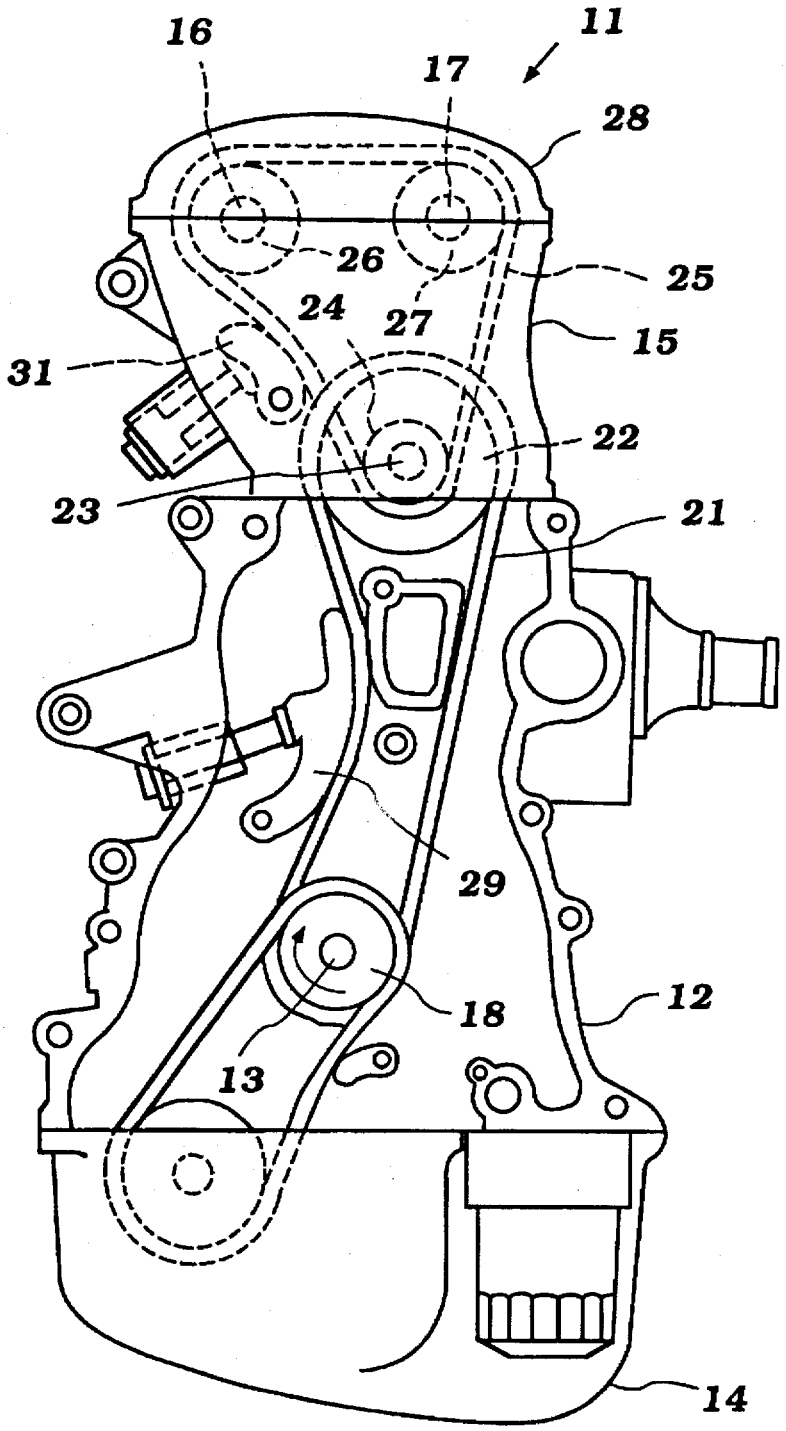
FIG. 2 is a front elevational view of the engine with the external accessories and front timing cover removed to more clearly show the drive arrangement for the camshaft of the engine.

Referring now in detail to the drawings and initially to FIGS. 1 and 2, an internal combustion engine constructed in accordance with an embodiment of the invention is identified generally by the reference numeral 11. In the illustrated embodiment, the engine 11 is of a multi-cylinder in line type and operates on a four-stroke principal. Although the invention is described in conjunction with an engine having this configuration, it will be readily apparent to those skilled in the art how the invention can be applied with engines having other cylinder configurations such as V-type or opposed engines. In addition, although the invention is described in conjunction with a multi-cylinder engine, it will also be readily apparent to those skilled in the art how the invention can be employed with single cylinder engines.

The engine 11 is comprised of a cylinder block 12 in which cylinder bores, to be illustrated in a later figure, are formed. A crankshaft, indicated by the reference numeral 13, is rotatably journalled within a crankcase chamber formed by a skirt of the cylinder block 12 and a crankcase member 14 that is detachably affixed to the lower end of the cylinder block 12.

The crankshaft 13 is driven by pistons (to be described later) that reciprocate in the cylinder bores and which are connected to the crankshaft 13 by connecting rods in a well-known manner.

A cylinder head assembly 15 is affixed to the upper end of the cylinder block 12 and has a lower sealing surface, as will be described, which closes the cylinder bores and forms combustion chambers therewith.

A pair of camshafts comprising an intake camshaft 16 and an exhaust camshaft 17 are journalled in the cylinder head 15 in a manner which will be described and operate the valves for the engine in a manner which also will be described by reference to the later figures.

The crankshaft 13 has affixed to it a drive sprocket 18 which is mounted within a timing case formed at the front of the cylinder block 12 and closed by a cover assembly 19. This sprocket 18 drives a first timing chain 21 which extends upwardly through the timing case and drives a sprocket 22 that is affixed to a cam driving shaft 23 which is journalled at the front of the engine and specifically the cylinder head 15. The sprocket 22 is formed with a further sprocket 24 which rotates with the sprocket 22 and which may be formed integrally with it. The sprocket 22 drives a second timing chain 25 which, in turn, drives sprockets 26 and 27 that are affixed to the front of the intake and exhaust camshafts 16 and 17, respectively.

In order to permit the driving sprockets 26 and 27 to be small and still drive the camshafts 16 and 17 at one-half the speed of the crankshaft 13, the speed reduction between the crankshaft 13 and camshafts 16 and 17 is done in two stages. The first stage comprising the sprockets 18 and 22 may, in fact, provide the entire 2-to-1 reduction while the second stage comprising the sprocket 24 and 26 and 27 has a unitary speed ratio. Alternatively, the speed reduction may have achieved in various proportions but by having it accomplished in two stages and, as has been noted, the sprockets 26 and 27 may be maintained small and, accordingly, the total cylinder head assembly 15 can be kept quite compact.

Although the drive is provided by a pair of driving sprockets 21 and 25, it will be readily apparent to those skilled in the art that the speed reduction may be accomplished by other types of flexible transmitter drives such as tooth belts or the like.

The cam tower of the cylinder head 15 is closed by a cam cover 28 that is affixed to the cylinder head 15 in any well known manner.

A first chain tensioner 29 is mounted at one side of the cylinder block 12 and engages the timing chain 21 so as to maintain its tension. A second chain tensioner 31 is mounted in the cylinder head 15 and engages the flight of the timing chain 25 that passes between the crankshaft sprocket 24 and intake camshaft sprocket 26. This maintains the tension on the chain 25. As will become apparent, the intake camshaft 16 is disposed closer to a plane containing the axis of the cylinder bore than is the exhaust camshaft 17. The chain tensioner 31 is positioned on the intake side of the engine so that it can be accommodated in this offset area of the intake camshaft 16.

Referring again to FIG. 1, the timing cover 19 closes the cylinder block timing case and also provides an integral water pump assembly, indicated generally by the reference numeral 32. The crankshaft 13 extends in part through the front cover 19 and a driving pulley 33 is affixed to this extending end of the crankshaft 13. A serpentine belt 34 is driven by the drive pulley 33 and drives a number of accessories mounted on the front of the engine 11. These accessories comprise an alternator 35 having a drive pulley 36 and which is mounted on the front of the engine on an accessory mounting bracket 37. The accessory mounting bracket 37 also mounts a idler pulley 38 which maintains the drive belt 34 in engagement with the driving pulley 33 and redirects it toward the alternator pulley 36.

The water pump 32 has a drive shaft 39 to which a water pump drive pulley 41 is affixed which, in turn, is driven by the drive belt 34.

A power steering pump 42 is mounted on the side of the engine 11 and specifically the cylinder head 15 opposite the alternator 35. This power steering pump has affixed to its drive shaft a pulley 43 which is also driven by the belt 34. Finally, an air-conditioning compressor 44 mounted on the lower side of the cylinder block 12 beneath the power steering pump 42 has a drive pulley 45 affixed to its crankshaft and this is also driven by the drive belt The construction of the engine as thus far described, including the drive for the camshafts 16 and 17 is disclosed in more detail in the copending application of Tetsushi Saito entitled ENGINE COOLING SYSTEM, Ser. No. 08/331,052 filed Oct. 28, 1994 and assigned to the assignee hereof. Since the invention in this application deals primarily with the construction of the cylinder head 15, the valve actuating mechanism and the manner in which the cylinder head 15 is affixed to the cylinder block 12 other details of the engine 11 and specifically the camshaft driving mechanism, water pump and accessory drives are not necessary to understand this invention. Reference may be had to the copending application, the disclosure of which is incorporated herein by reference, for these details.

Figure 7:
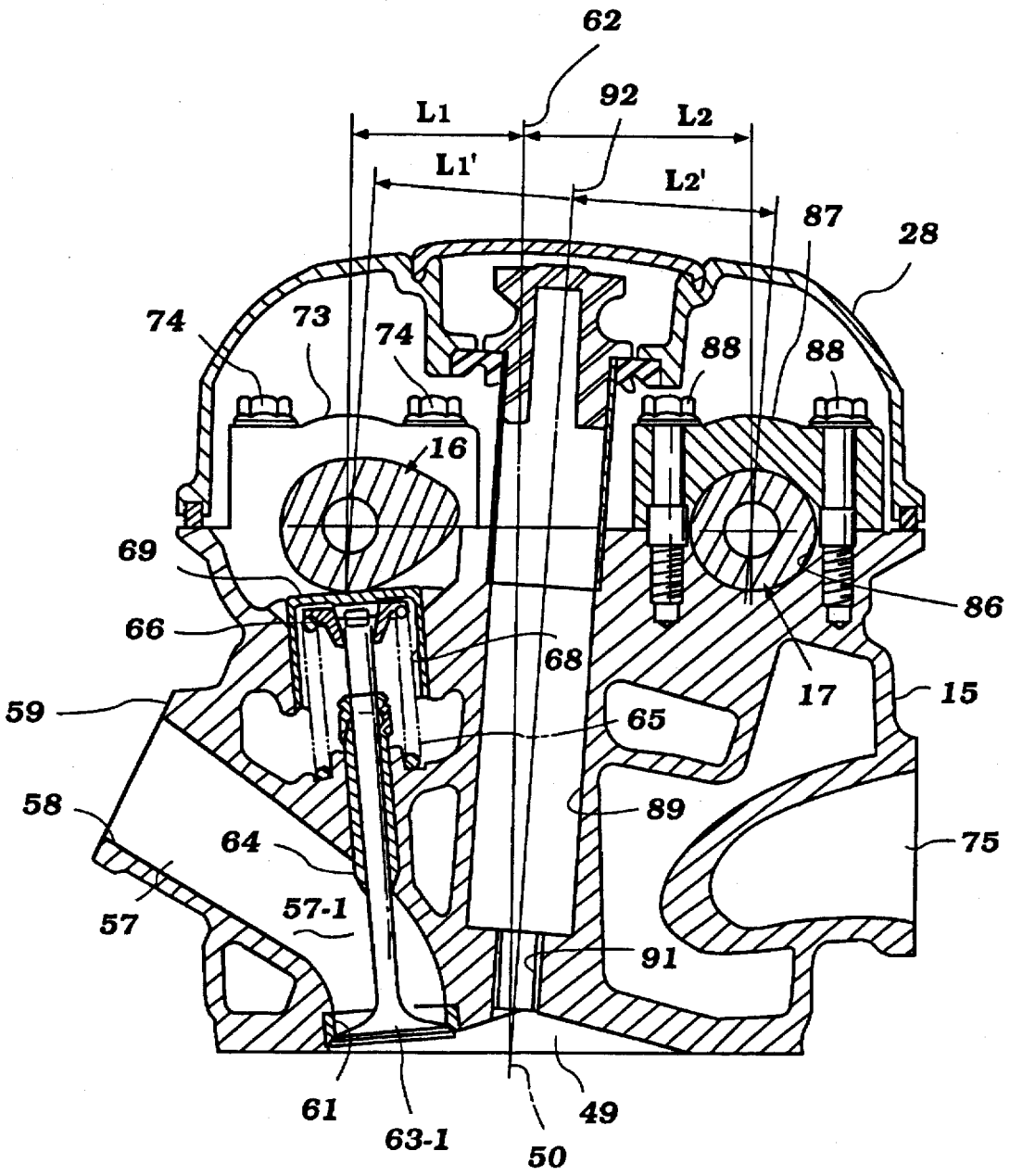
FIG. 7 is a cross-sectional view taken along the line 7—7 of FIG. 3.
Figure 8:
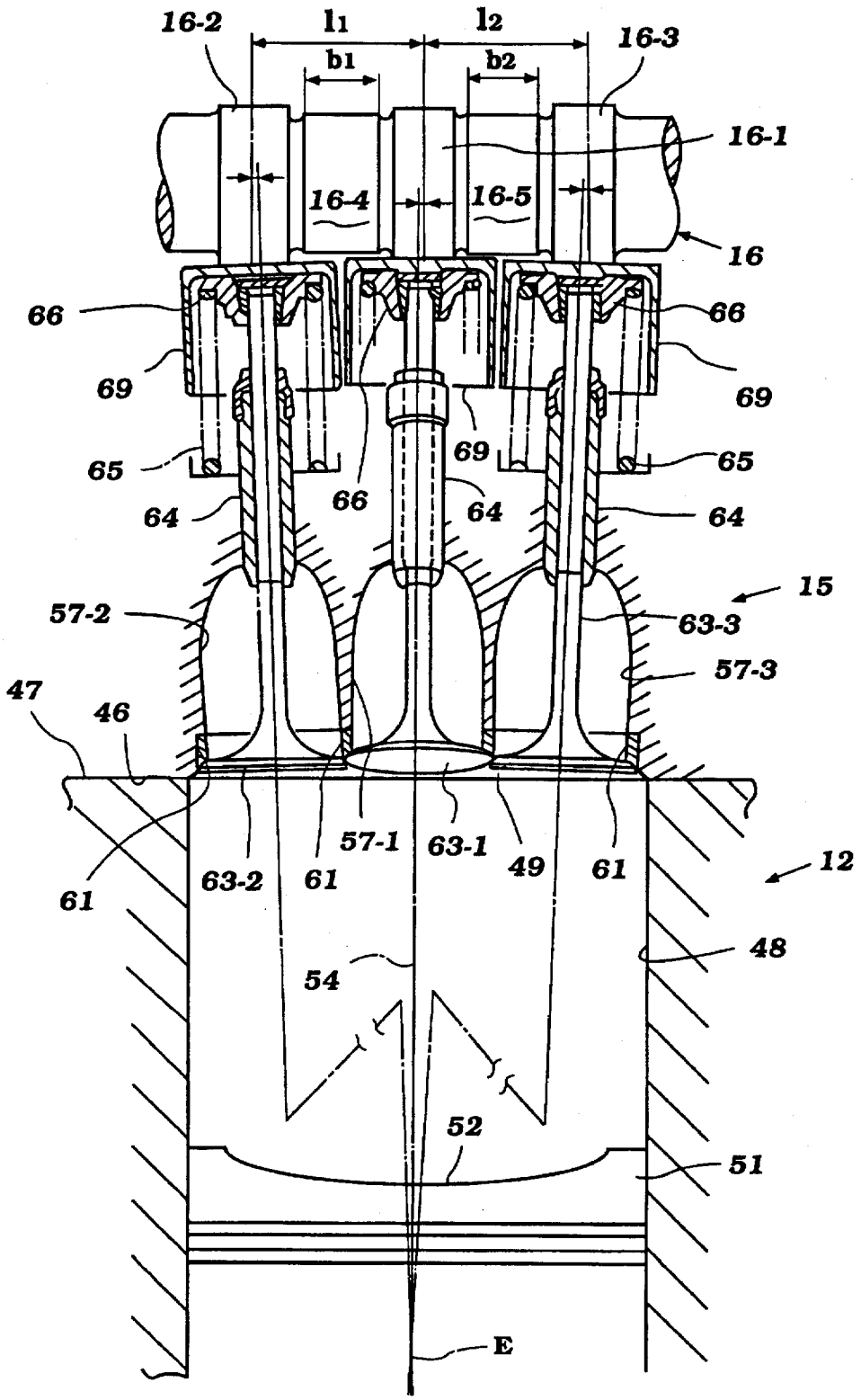
FIG. 8 is a cross-sectional view taken along a plane passing through the cylinder head that extends parallel to a plane containing the axes of rotation of the engine crankshaft and through the intake valves of the engine.

Referring now in detail to the remaining figures (FIGS. 3–8), the cylinder head 15 has a lower surface 46 that is brought into sealing engagement with an upper surface 47 of the cylinder block around the individual cylinder bores 48 (FIG. 8). The cylinder head surface 46 surrounds individual combustion chamber recesses 49 formed in the lower surface of the cylinder head 15. These recesses 49 cooperate with the cylinder bores 48 and the heads of pistons 51 to form the combustion chambers of the engine. As described in my copending application entitled ENGINE COMBUSTION CHAMBER AND AIR INTAKE DEVICE, Ser. No. 08/354,539, filed Dec. 13, 1994, which application is a continuation-in-part of my copending application entitled ENGINE AIR INTAKE DEVICE, Ser. No. 08/197,610, filed Feb. 17, 1994, which applications are assigned to the assignee hereof, the head of the piston 51 is formed with a recess 52 which cooperates with the cylinder bore 48 and cylinder head recess 49 to form a lens-shaped combustion chamber. The disclosures of my copending applications are incorporated herein by reference.

Figure 5:
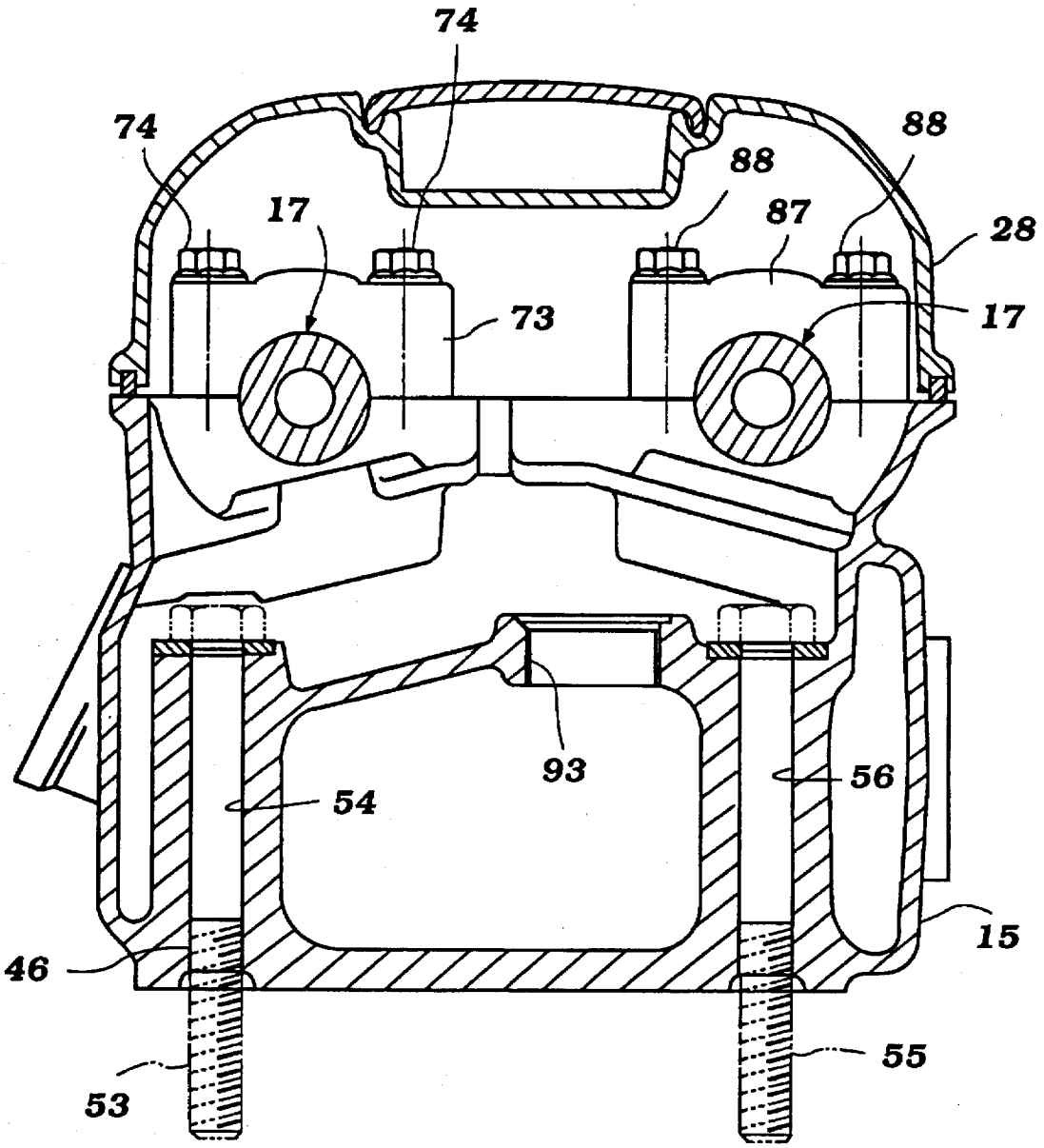
FIG. 5 is a cross-sectional view taken along the line 5—5 of FIG. 3.

The cylinder head 15 is affixed in this sealing relationship to the cylinder block 12 by a plurality of threaded fasteners which generally comprise a first pair of fasteners 53 which are disposed on the intake side of the cylinder head 15 and which are spaced transversely outwardly relative to the cylinder bore axis, indicated by the line 54 in FIG. 5, a distance that is greater than the distance the axis of rotation of the intake camshaft 16 from a plane containing the cylinder bore axes 50 and the axis of rotation of the crankshaft 13. This distance of the intake camshaft axis from the plane is indicated by the dimension $L_1$ in FIG. 7. The fasteners 53 pass through suitable bores 54 formed in the cylinder head 15. The fasteners 53 may be bolts as shown in FIG. 5 or may be comprised of studs with nuts being affixed to the upper ends thereof, as is well known in this art.

A second series of threaded fasteners 55 pass through openings 56 formed in the cylinder head 15 on the exhaust side of the cylinder head 15. It should be noted that the axes of rotation of the exhaust camshaft 17 is disposed at a distance $L_2$ from the aforenoted plane, which distance is greater than the distance $L_1$. As a result, the threaded fasteners 55 lie beneath the exhaust camshaft 17 as clearly shown in FIG. 5.

The threaded fasteners 53 and 55 are disposed an equal distant from the cylinder bore axis 54 and thus maintain good and uniform hold down torque on the cylinder head 15 and cylinder block 12. For adjacent cylinders, the threaded fasteners 53 and 55 between the adjacent cylinders serve the hold down function for the cylinder head 15 over the adjacent cylinders.

An intake passage, indicated generally by the reference numeral 57 is formed on the side of the cylinder head 15 where the intake camshaft 16 is journalled. In the illustrated embodiment, the intake passage 57 is a siamese passage that begins with an opening 58 formed in an external surface 59 of the cylinder head 15 to which an appropriate intake manifold (not shown) is affixed for delivering at least an air charge to the combustion chamber recesses 49. As is noted, the intake passage 57 is of the siamese type and from the common inlet opening 58 the passage 57 splits into three branch passages comprised of a center portion 57-1 and a pair of side portions 57-2 and 57-3. These portions all end in respective intake valve seats 61 which are either pressed or cast in place in the cylinder head 15.

The valve seat 61 associated with the center intake passage 57-1 is disposed adjacent the peripheral edge of the cylinder bore 48 and is furthest from the plane containing the cylinder bore axis 50 and the axis of rotation of the crankshaft. This plane is identified by the reference numeral 62. The intake valve seat 61 associated with the side intake passages 57-2 and 57-3 lie closer to and, in fact, extend partially over this plane 62 onto the exhaust side of the cylinder head 15.

Figure 6:
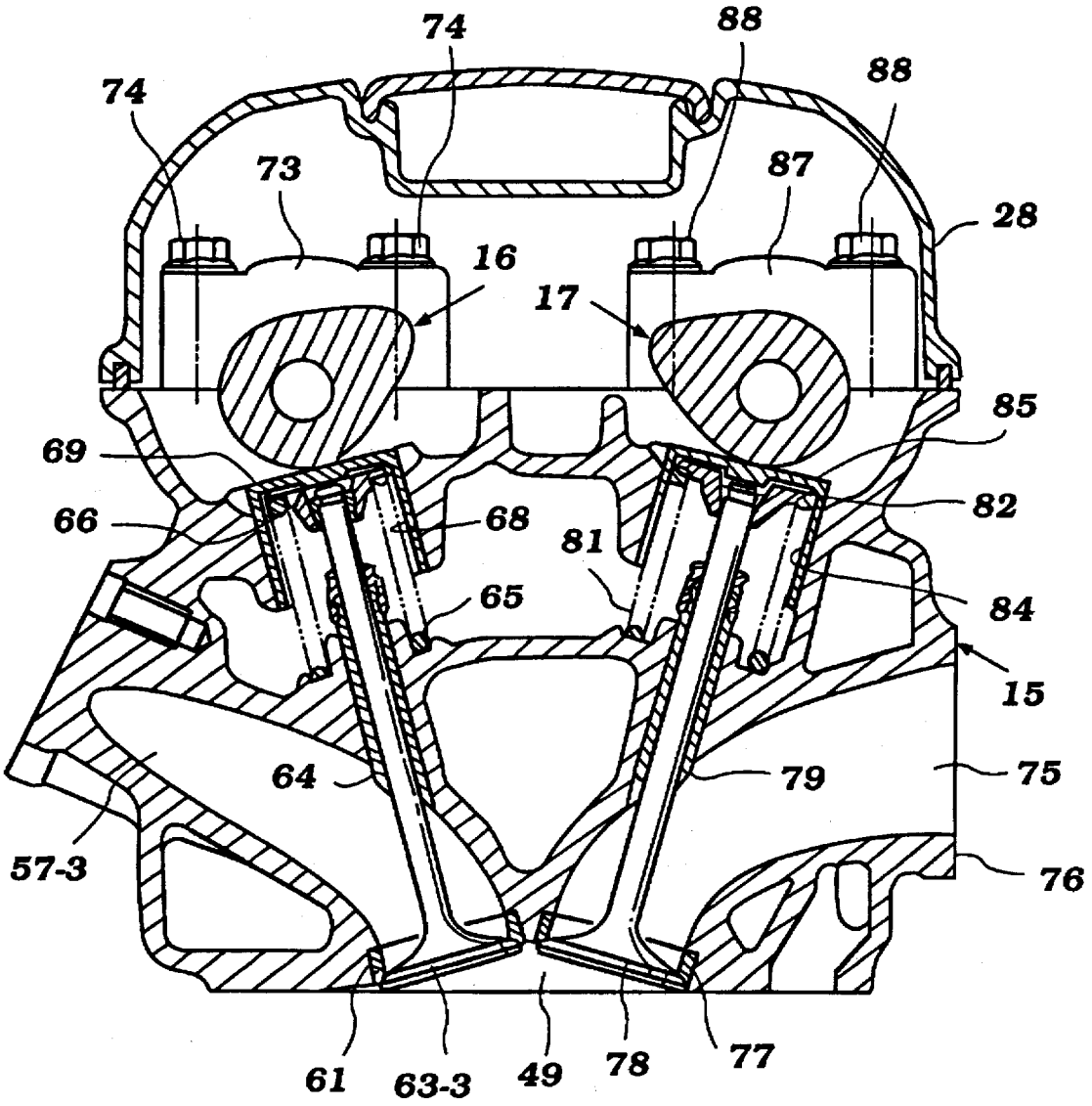
FIG. 6 is a cross-sectional view taken along the line 6—6 of FIG. 3.

Poppet type intake valves comprised of a center intake valve 63-1 and side intake valves 63-2 and 63-3 are slidably supported in respective valve guides 64 in the cylinder head 15 and have their head portions in cooperating relationship with the valve seat 61 so as to control the flow entering the combustion chamber 49 through the intake passages 57-1, 57-2 and 57-3. As described in my aforenoted copending application, looking in the planes extending perpendicularly to the plane 62 as shown in FIGS. 6 and 7, the side intake valves 63-2 and 63-3 reciprocate about axes that lie in a common plane and which is disposed at an acute angle to the plane 62. The center intake valve 63-1 has its reciprocal axis lying at an acute angle to the plane 62 but this acute angle is lesser than that of the side intake valves.

As a result of this positioning, the flow of the intake charge entering the combustion chamber through the center intake passage 57-1 and its associated valve seat 61 will flow in a direction generally parallel to the cylinder bore axis 54 while the flow from the side intake valve seats associated with the side intake passages 57-2 and 57-3 will tend to flow across the cylinder bore axis and generate a tumble motion to the charge inducted into the combustion chamber.

When viewed in a direction perpendicular to the direction of FIGS. 6 and 7 as shown in FIG. 8, it will be noted that the side intake valves 63-2 and 63-3 have their axes slightly skewed relative to the axis of reciprocation of the center intake valve 63-1 so that the flow paths will intersect at a point E which is disposed below the head of the piston 51 when it is in its bottom dead center position as shown in FIG. 8. This ensures that there will be no conflicting flow from the various intake passages 57-1, 57-2 and 57-3 that could interfere with the tumble motion generated to the intake charge.

The intake valve 63 are each urged to their closed positions by respective coil compression springs 65 that are loaded between a machined surface formed on the upper portion of the cylinder head 15 and a keeper retainer assembly 66 that is affixed to the upper end of the stems of the respective intake valves 63.

The cylinder head 15 is provided with an upstanding wall 67 in the area on the intake side of each cylinder bore 44 that is formed with a plurality of bores 68 for receiving respective thimble tappets 69 that are associated with the keeper retainer assembly 66 and the upper ends of the stems of the intake valve 63 for their operation. It should be noted that these bores 68 are skewed so that they extend parallel to the axes of reciprocation of the respective valve 63-1, 63-2 and 63-3. Because of this skewing, the area of the wall 67 between the lower ends of the bore 69 is less than that at the upper ends. This is done so as to maintain a relatively compact cylinder head configuration.

The intake camshaft 16 is provided with three lobes for each cylinder bore 48 comprised of a center lobe 16-1 which cooperates with the center intake valve 63-1 and a pair of side lobes 16-2 and 16-3 which cooperate with the tappet 69 for actuating the side intake valve 63-2 and 63-3. It should be noted that the center of each lobe 16-1, 16-2 and 16-3 is offset slightly from the center of the tappet 69 and respective valve stem 63-1, 63-2 and 63-3. In viewing FIG. 8, it will be seen that the lobe 16-1 is offset from the center of the intake valve 63-1 toward the right hand side of the figure by a distance $e_2$. The lobe 16-3 is offset relative to the axis of the intake valve 63-3 and its tappet 69 in the same direction but by a slightly different amount $e_3$. The remaining cam lobe 16-2 is offset from the center of its intake valve 63-2 and tappet 69 by a dimension $e_1$ which may be slightly greater than the dimension $e_2$ but in the opposite direction (to the left). This offsetting of the centers of the cam lobes 16-1, 16-2 and 16-3 relative to the tappet 69 will cause a slight degree of rotation of the tappets 69 during the running of the engine so as to make wear both on the tappets 69 cylinder head bores 68 and cam lobes 16-1, 2 and 3 more uniform.

As a result, the distance between the center of the center lobe 16-1 and the side lobe 16-2 ($L_1$) is greater than the distance between the center lobe 16-1 and the other side lobe 16-3, the distance $L_2$ in FIG. 5. As a result, the bearing surfaces 16-4 and 16-5 form between the cam lobes 16-1 and 16-2 and 16-1 and 16-3, respectively, will have a different effective length. These length b1 and b2 are indicated in FIG. 8.

The cylinder head wall 67 has a pair of bearing portions 71 and 72 which are machined so as to receive the bearing surfaces 16-5 and 16-4, respectively, for journalling the camshaft 16 in the cylinder head 15. Bearing caps 73 are affixed to the surfaces 71 and 72 by threaded fasteners 74 so as to complete the journalling of the intake camshaft 16 in the cylinder head 15. These caps 73 lie axially between the cylinder head fasteners 53.

Figure 3:
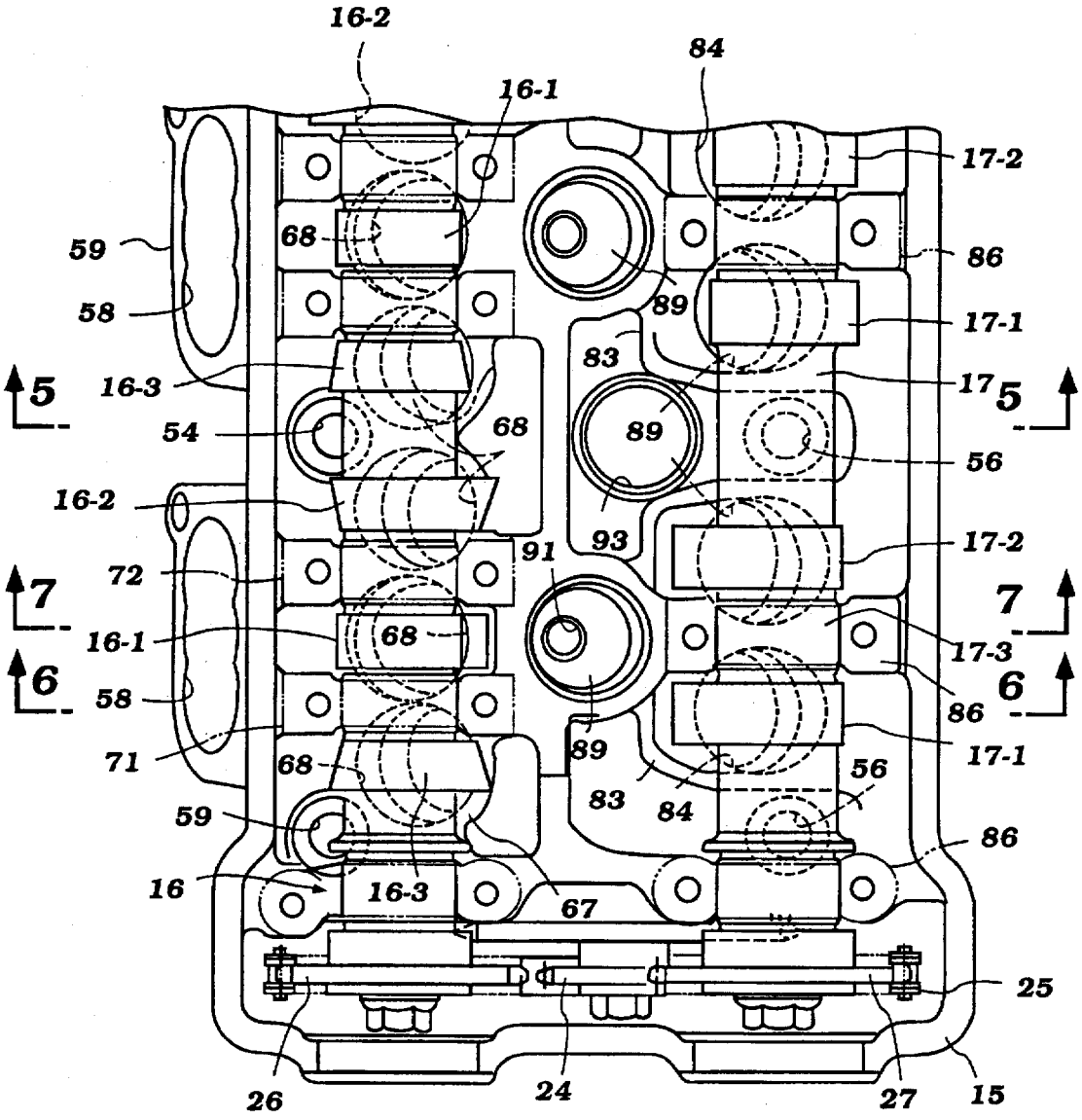
FIG. 3 is a top plan view of the forward portion of the cylinder head with the cam cover and bearing caps removed.

Finally, it should be noted that the lobes 16-2 and 16-3 are tapered so as to accommodate the skewed axes of the side intake valves 63-2 and 63-3, this taper being shown in FIG. 3 with some degree of exaggeration. It should be noted that the outermost threaded fastener 74 are disposed substantially in line with the cylinder head recesses 54 that receive the cylinder head threaded fasteners 53. This may be seen in FIGS. 3 and 5.

It should also be noted that the openings 54 and threaded fasteners 53 associated with each cylinder bore 18 are disposed in the area along the length of the engine which is encompassed by the wall 67 in which the tappet receiving bore 68 are formed. However, the openings 54 are disposed outwardly of the areas 71 and 72 that journal the camshaft bearing surfaces 16-5 and 16-4, respectively.

Figure 4:
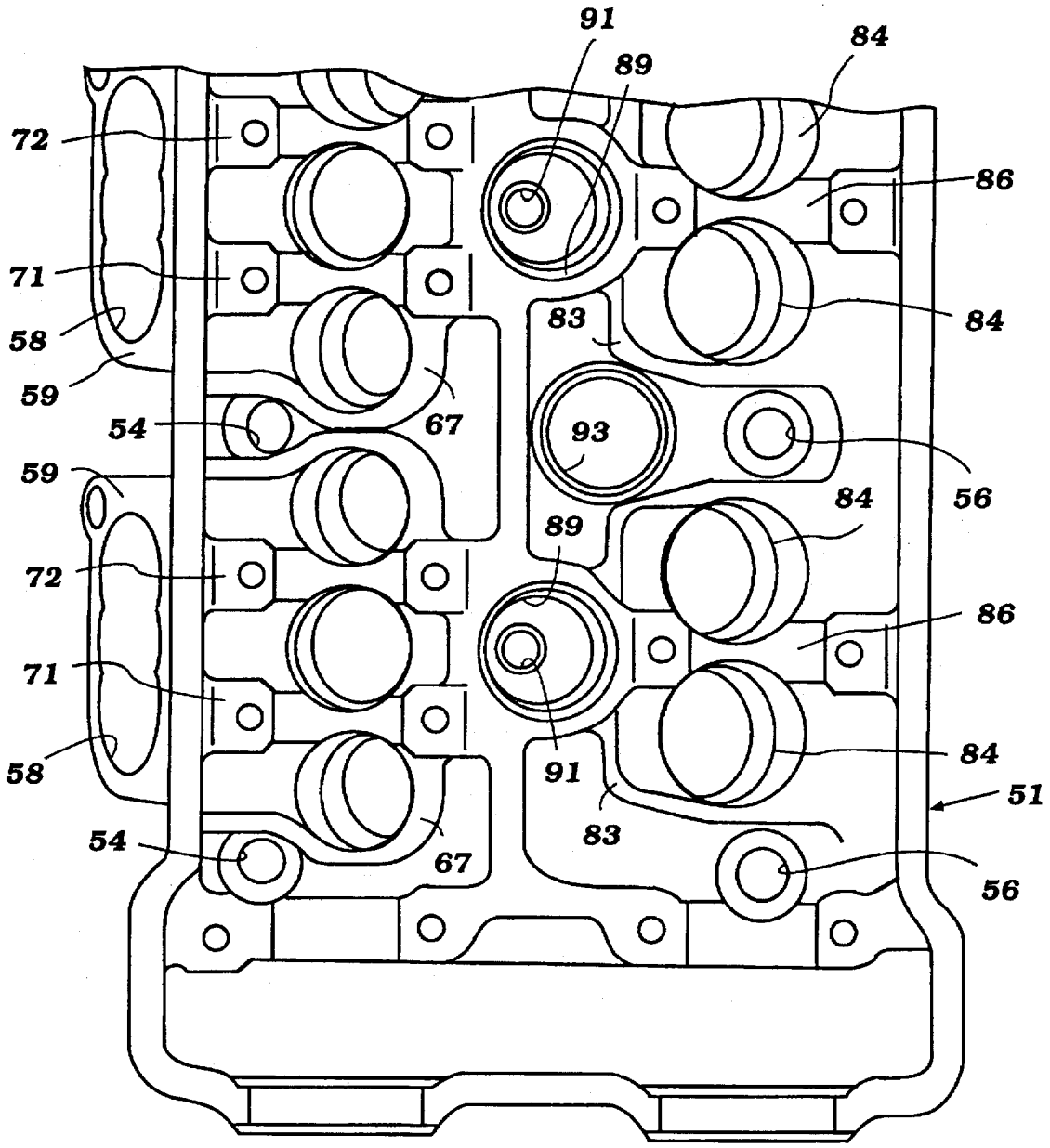
FIG. 4 is an enlarged view in part similar to FIG. 3 but further removing the camshafts and drive therefor.

Turning now to the exhaust side of the engine which is shown primarily in FIGS. 3, 4 and 6, individual or siamese exhaust passages 75 extend from outlet openings in a side surface 76 of the cylinder head 15 to which an exhaust manifold (not shown) is attached. These exhaust passages 75 terminate in exhaust valve seats 77 formed in the combustion chamber recesses 49 of the cylinder head 15.

Exhaust valves 78 of the poppet type have their head portions adapted to control the flow through the exhaust valve seat 77 in a well known manner. The exhaust valves 78 are slidably supported in the cylinder head for reciprocation along axes defined by exhaust valve guides 79 suitably affixed in the cylinder head 15. The axes of reciprocation of the exhaust valves 78 lie in a common plane that is disposed at an acute angle to the plane 62 containing the cylinder bore axis 54. This acute angle is greater than the acute angle of the side intake valves 63-2 and 63-3 and less than that of the center intake valve 63-1. These axes are not, in the illustrated embodiment, skewed in the plane of FIG. 8.

Coil compression springs 81 encircle the stems of the exhaust valves 78 and act against machined surfaces of the cylinder head 15 and keeper retainer assemblies 82 for urging the exhaust valves 78 to their closed positions. An upstanding wall portion 83 (FIGS. 3 and 4) of the cylinder head 15 is formed with a pair of parallel bores 84 for each cylinder 18. Thimble or bucket type tappets 85 are slidably supported in the bores 84 and engage the stems of the valve 78 and keeper retainer assemblies 82 for actuating the exhaust valves 78. The thimble tappets 84 are actuated by lobes 17-1 and 17-2 of the exhaust cam shaft 17. The head fasteners 55 lie axially outwardly of the bearing caps 87.

The wall 83 has a portion 86 that journals a bearing surface 17-3 of the exhaust camshaft 17 formed between the adjacent lobes 17-1 and 17-2. Bearing caps 87 are affixed to the wall portions 86 by threaded fasteners 88 for completing the journalling of the exhaust camshaft 17.

Spark plug wells 89 are formed in the cylinder head 15 centrally over the combustion chamber recesses 49. These wells 89 are formed in an area where the walls 67 and 83 which journal the intake and exhaust camshafts 16 and 17 and form the tappet receiving bores 68 and 83 merge with each other. A threaded opening 91 formed at the lower portion of the wells 89 receives a spark plug (not shown) so that its spark gap will be positioned substantially centrally within the recess 49 of the cylinder head 15.

It should be noted that the wells 89 and tapped openings 91 lie on an axis 92 (FIG. 7) that is disposed at an acute angle to the plane 62 and cylinder bore axis 54 on the exhaust side of the engine. This angle is less than the acute angle of the reciprocal axes of the exhaust valve 78. It should be noted that in a plane perpendicular to the spark plug well axis 92, the axis of rotation of the intake camshaft 16 is at a greater distance $L_1$ than the distance from the axis of rotation of the exhaust camshaft 17. This latter distance is indicated at $L_2$. Although $L_1$ is less than $L_2$, the difference between these distances is less than the distances relative to the cylinder bore axis 54 $L_1$ and $L_2$, respectively. That is, $L_2-L_1$ is greater than $L_2-L_1$.

It should also be noted that the fastener receiving recesses 56 on the exhaust side of the engine and their related threaded fasteners 55 are spaced axially outwardly beyond the wall 83 but are transversely inwardly from the outer periphery of this wall. Said another way, the threaded fasteners 55 and recesses 56 between adjacent cylinders lie between the wall portions 83 of the adjacent cylinders.

The area on the exhaust side of the engine between the walls 83 is formed with one or more clean-out openings 93 for cleaning sand from the casting process of the cylinder head 15. These openings 93 are then closed by suitable Welch plugs or the like.

It should be readily apparent that the described cylinder head construction permits the formation of a very compact cylinder head and yet one which accommodates 5 valves per cylinder and twin overhead camshafts. In addition, the structure permits the positioning of the cylinder head hold down fasteners so that they will provide uniform sealing pressure around the cylinder bores. Of course, the foregoing description is that of a preferred embodiment of the invention and various changes and modifications may be made without departing from the spirit and scope of the invention, as defined by the appended claims.

I claim:

1. A cylinder head assembly for an internal combustion engine, comprising a lower surface adapted to sealingly engage a cylinder block around a cylinder bore, a first series of three poppet valves supported for reciprocation within said cylinder head on substantially one side of a plane containing the axis of the cylinder bore, a second series of at least two poppet valves supported for reciprocation in said cylinder head substantially on the other side of said plane, a first camshaft rotatably journaled by a cylindrical portion thereof in said cylinder head and operating said first set of valves, a second camshaft rotatably journaled by said cylinder head and operating said second set of valves, a first pair of threaded fastening means disposed on said other side of said plane and substantially at the same distance therefrom as the rotational axis of said second camshaft for affixing said cylinder head to the associated cylinder block, and a second pair of threaded fastening means on said one side of said plane and having their axes spaced further from said plane than the outer periphery of the cylindrical portion of said first camshaft for affixing said cylinder head to the associated cylinder block.

2. The cylinder head assembly of claim 1, wherein the rotational axis of the first camshaft is closer to the plane than the rotational axis of the second camshaft.

3. The cylinder head assembly as set forth in claim 2, wherein the axes of each of the threaded fastening means disposed at the same distance from the cylinder bore axis.

4. The cylinder head assembly of claim 1, wherein the first camshaft has three lobes, each associated with a respective one of the first series of poppet valves for actuating said first series of said poppet type valves, the second camshaft having at least two lobes each associated with a respective one of the second series of poppet valves for operating said second series of poppet valves.

5. The cylinder head assembly of claim 4, further including bearing means disposed between the cam lobes of said camshafts and journaled in cooperating bearing surfaces of said cylinder head, and bearing caps affixed to said cylinder head and engaging said bearing surfaces of said camshafts for rotatably journaling said camshafts.

6. The cylinder head assembly of claim 5, further including a third series of threaded fastening means for affixing the bearing caps to the cylinder heads.

7. The cylinder head assembly of claim 6, wherein at least some of the third series of threaded fastening means are disposed at substantially the same distances from the plane as the pairs of threaded fastening means.

8. The cylinder head assembly of claim 7, wherein the rotational axis of the first camshaft is closer to the plane than the rotational axis of the second camshaft.

9. The cylinder head assembly of claim 8, wherein the cylinder head is formed with integral bores for slidably supporting tappets for actuating the respective poppet valves, said bores and said camshaft bearing surfaces being formed integrally with said cylinder head so that said cylinder head forms an integral piece for attachment to the cylinder block.

10. The cylinder head assembly of claim 9, wherein the integral bores of the cylinder head for slidably receiving the tappets for actuating the first series of valves is formed in a first outstanding wall of the cylinder head and wherein the integral bores for receiving the tappets associated with the second series of valves is formed by another upstanding integral wall of said cylinder head.

11. The cylinder head assembly of claim 10, wherein the second pair of threaded fastening means are disposed transversely outwardly beyond the end portions of the first wall.

12. The cylinder head assembly of claim 10, wherein the threaded fastening means of the respective pairs of threaded fastening means are disposed axially outwardly of the respective first and second walls in a direction extending along the plane containing the cylinder bore axes.

13. The cylinder head assembly of claim 12, wherein the second pair of threaded fastening means are disposed transversely outwardly beyond the end portions of the first wall.

14. The cylinder head assembly of claim 1, further including a spark plug receiving recess formed integrally in the cylinder head and terminating in a tapped opening extending to the lower surface of the cylinder head for threadedly receiving a spark plug, said spark plug well having an axis that is disposed at an acute angle to the plane containing the cylinder bore axes and lying on the other side of the plane, the perpendicular distance between said plane and the axis of rotation of the first camshaft being disposed further from said spark plug well axis than the rotational axis of said second camshaft.

15. The cylinder head assembly of claim 14, wherein the difference in distance between the spark plug axis and the axes of rotation of the first and second camshafts is less than the difference in distance between the rotational axes of the first and second camshafts and the plane.

16. The cylinder head assembly of claim 2, further including a cam driving shaft rotatably journaled by the cylinder head and a first flexible transmission for driving said camshafts from said cam driving shaft, said cam driving shaft being driven by a second flexible transmission from the crankshaft of the engine, said camshafts being driven by said first and said second flexible transmissions at one-half crankshaft speed.

17. The cylinder head assembly of claim 16, further including a tensioner for the first flexible transmission for tensioning the flight of the first flexible transmission between the camshaft driving shaft and the first camshaft.

18. The cylinder head assembly of claim 16, wherein the speed reduction between the crankshaft and the camshaft is provided at least in part by the second flexible transmission.

19. The cylinder head assembly of claim 18, further including a tensioner for the first transmission for tensioning the flight of the first flexible transmission between the camshaft driving shaft and the first camshaft.

20. A cylinder head assembly for an internal combustion engine and having a lower surface for sealingly engaging a cylinder block around a cylinder bore therein, a first series of three poppet valves supported for reciprocation within said cylinder head substantially on one side of a plane containing the axis of the cylinder bore, a second set of at least two poppet valves supported for reciprocation within said cylinder head on the other side of said plane, a first camshaft rotatably journaled on bearing surfaces formed in said cylinder head on said one side of said plane and over said cylinder bore for operating said first set of poppet valves, a second camshaft rotatably journaled in bearing surfaces of said cylinder head on the other side of said plane for operating said second set of valves, bearing cap means affixed to said cylinder head over said cylinder bore for rotatably journaling said camshafts, and two pairs of threaded fastening means, each pair being disposed on a respective side of said plane, for affixing said cylinder head to the associated cylinder block, the pairs of threaded fastening means being disposed outwardly from said bearing caps along the longitudinal direction of said plane.

21. The cylinder head assembly of claim 20, further including a further threaded fastening means for affixing said cylinder to a cylinder block.

22. The cylinder head assembly of claim 21, wherein at least some of said further threaded fastening means are aligned at the same distance from the plane as one of said first pair of threaded fastening means.

* * * * *